US009333613B2

(12) United States Patent
Friel, Sr. et al.

(10) Patent No.: US 9,333,613 B2
(45) Date of Patent: May 10, 2016

(54) SHARPENER FOR KNIVES WITH WIDELY DIFFERENT EDGE ANGLES

(75) Inventors: Daniel D. Friel, Sr., Greenville, DE (US); Bela Elek, Wilmington, DE (US)

(73) Assignee: EDGECRAFT CORPORATION

( * ) Notice: Subject to any disclaimer, the term of this patent is extended or adjusted under 35 U.S.C. 154(b) by 1318 days.

(21) Appl. No.: 12/401,034

(22) Filed: Mar. 10, 2009

(65) Prior Publication Data

US 2009/0233530 A1 Sep. 17, 2009

Related U.S. Application Data

(60) Provisional application No. 61/035,524, filed on Mar. 11, 2008.

(51) Int. Cl.

| | |
|---|---|
| ***B24B 3/36*** | (2006.01) |
| ***B24B 3/54*** | (2006.01) |
| ***B24D 15/06*** | (2006.01) |
| ***B24D 15/08*** | (2006.01) |
| ***B24B 3/58*** | (2006.01) |

(52) U.S. Cl.

CPC ... *B24B 3/54* (2013.01); *B24B 3/36* (2013.01); *B24B 3/543* (2013.01); *B24B 3/58* (2013.01); *B24D 15/06* (2013.01); *B24D 15/08* (2013.01)

(58) Field of Classification Search

CPC ..... B24B 3/36; B24B 3/54; B24B 3/543; B24B 3/58; B24B 3/586; B24B 7/17; B24D 15/06; B24D 15/08

USPC ..... 451/45, 192, 198, 261, 262, 263, 267

See application file for complete search history.

(56) References Cited

U.S. PATENT DOCUMENTS

| | | | |
|---|---|---|---|
| 4,627,194 | A | 12/1986 | Friel |
| 4,716,689 | A | 1/1988 | Friel |
| 4,807,399 | A | 2/1989 | Friel |
| 4,897,965 | A | 2/1990 | Friel |
| 5,005,319 | A | 4/1991 | Friel |
| 5,148,634 | A | 9/1992 | Bigliano |
| 5,245,791 | A | 9/1993 | Bigliano |
| 5,390,431 | A | 2/1995 | Friel |
| 5,611,726 | A | 3/1997 | Friel |
| 6,012,971 | A | 1/2000 | Friel |

(Continued)

*Primary Examiner* — Eileen Morgan

(74) *Attorney, Agent, or Firm* — Drinker Biddle & Reath LLP

(57) ABSTRACT

A wide range of knives and blades, including Western, Asian or traditional Japanese style blades that have a primary edge facet on at least one side of the knife edge are sharpened through use of an electric knife sharpener having a first sharpening stage with at least one rotating abrasive surface disk and a knife angle guide to position the blade's facet at a first relative angle of approximately 15 degrees as it contacts the moving abrasive surface. The knife sharpener includes a second sharpening stage with at least one rotating abrasive surfaced disk and a knife angle guide to position the blade's facet at a second relative angle of approximately 20 degrees as it contacts the rotating abrasive surface. The knife sharpener also has a third stropping stage with at least one rotating stropping disk containing abrasive particles of less than 1 thousandth of inch diameter and a knife angle guide to position the blade's facet at a third relative angle larger than the first and second angles as it contacts the rotating surface of the stropping disk. The rotating sharpening and stropping disks are displaceable from a rest position against specific restraining forces when contacted by the edge facet being sharpened or stropped.

22 Claims, 2 Drawing Sheets

(56) References Cited

U.S. PATENT DOCUMENTS

| | | | | |
|---|---|---|---|---|
| 6,113,476 | A | 9/2000 | Friel | |
| 6,267,652 | B1 * | 7/2001 | Friel et al. | 451/177 |
| 6,802,763 | B1 | 10/2004 | Leung | |
| 6,863,600 | B2 | 3/2005 | Friel | |
| 6,875,093 | B2 | 4/2005 | Friel | |
| 6,881,137 | B2 * | 4/2005 | Friel, Sr. | 451/349 |
| 6,997,795 | B2 * | 2/2006 | Friel, Sr. | 451/555 |
| 7,235,004 | B2 | 6/2007 | Friel | |
| 7,287,445 | B2 | 10/2007 | Friel | |
| 7,488,241 | B2 | 2/2009 | Elek | |
| 7,494,403 | B2 | 2/2009 | Friel | |
| 7,517,275 | B2 * | 4/2009 | Friel et al. | 451/198 |
| 2004/0198198 | A1 * | 10/2004 | Friel et al. | 451/198 |
| 2007/0281590 | A1 * | 12/2007 | Friel et al. | 451/45 |

* cited by examiner

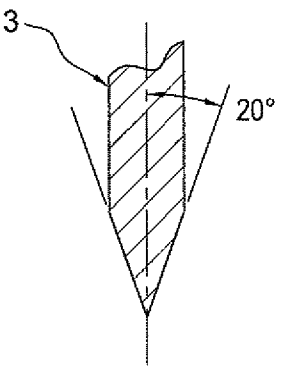
FIG. 1
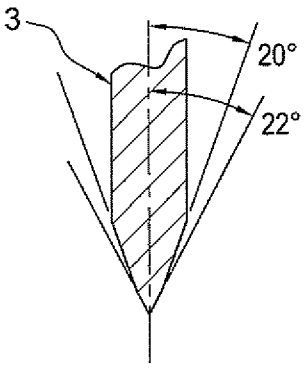
FIG. 2
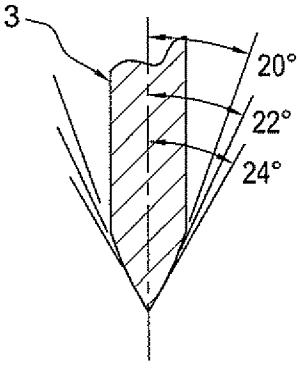
FIG. 7
FIG. 3
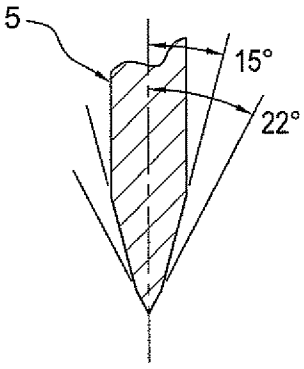
FIG. 4
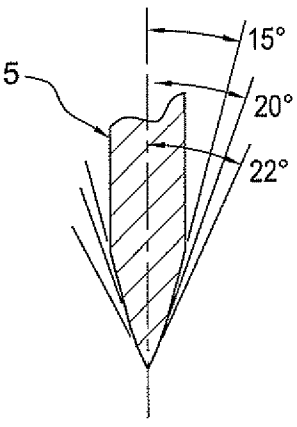
FIG. 5
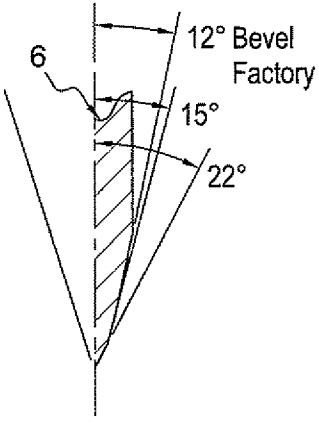
FIG. 6

SHARPENER FOR KNIVES WITH WIDELY DIFFERENT EDGE ANGLES

CROSS-REFERENCE TO RELATED APPLICATION

This application is based on provisional application Ser. No. 61/035,524, filed Mar. 11, 2008, all of the details of which are incorporated herein by reference thereto.

BACKGROUND OF THE INVENTION

This invention relates to a precise knife sharpener that is strikingly novel and versatile in that it can sharpen virtually all of the large variety of knives made throughout the world, with widely different edge angles, to create edges of original factory quality. Knives made in multiple locations around the world vary widely in their style, in shape, in the type of metals utilized, in the hardness of the blades, in the contours of the blade faces, the slope of the blade faces, the number of primary facets (one or two), created to form the edge, and most importantly the angle of the primary facets along the knife edge. These wide differences have evolved as a result of the needs of different cultures in local regions. Successive generations have searched for sharper and stronger edges and the sharpening means to create them on the knives that are common to their culture.

In recent years many advanced electrically powered means of sharpening have been introduced in the Western world for use by the general public. In large these have been designed for knives of European or American origin and derivatives of their designs. In Asian countries knives have been sharpened largely by hand and extensive training programs are customary to train artisans and chefs in the complex art of hand sharpening. Serious artisans in Asian countries spend years mastering the art of creating a very sharp knife edge and even with such training spend many minutes or an hour each day sharpening a single sashimi blade. The sharpening of Asian style blades has for many years remained somewhat of an art.

In spite of wide differences in cosmetics, materials of construction, and physical shapes, knives from Asia are generally sharpened at very low edge angles with a primary edge facet centered at about 15°. Knives of European, American or Western countries generally are sharpened at higher angles of about 20° for the primary facet. Knives in Asia have been used widely for fish and softer foods while the Western countries have consumed more meat and tougher foods more difficult to cut. Hence the Western countries have adopted larger angled, 20 degree, edged knives that will hold an edge longer in difficult cutting situations.

The most advanced professional sharpeners available today are precision multistage devices that require 3 successive stages to sharpen just one class of knives.

Because of the dominance of 20° primary facets on knifes in the West virtually all modern precision knife sharpeners have been designed to sharpen knives only at 20° facets. As a consequence those who prefer Asian blades commonly find it necessary to sharpen by hand at the smaller 15° angle.

Recently Asian knives have become more popular in the Western world and these inventors have recently developed and introduced sharpeners that sharpen exclusively knives that have the Asian 15° primary facets. There are also specialized sharpeners for hunting knives. In the face of the growing precision and complexity of these modern specialized precision sharpeners it has not been apparent that any one precision sharpener could be made flexible enough to sharpen both 15° and 20° knives and yet create better than factory quality edges on both. These inventors have however now created a unique household sharpener design that can for the first time sharpen virtually all of the world's very different knives in one sharpener to better than original factory quality.

SUMMARY OF THE INVENTION

These inventors have discovered that by using a non-intuitive combination of sharpening angles, abrasive materials and procedures it is possible in one three-stage sharpener to produce factory quality edges on all types of Western style and Asian style blades. The unique features of this sharpener permit precision sharpening also of thick hunting blades with complex blade face and facet geometries and even small kitchen and pocket blades. In each case the resulting knife edges are equal to or superior to factory edges in all respects and in particular for those characteristics that are most important—namely sharpness and durability.

THE DRAWINGS

FIG. 1 is a cross sectional view of a Euro-American style knife blade and edge sharpened at a conventional 20° angle.

FIG. 2 is a cross sectional view of the knife of FIG. 1 after a small bevel has been added at the edge.

FIG. 3 is a cross sectional view of an Asian style knife blade edge sharpened at the common Asian angle of 15 degrees.

FIG. 4 is a cross sectional view of the Asian style knife blade edge of FIG. 3 after a small bevel has been added at its edge.

FIG. 5 is a cross sectional view of the same Asian knife edge of FIGS. 3 and 4 after a second small bevel has been added at its edge.

FIG. 6 is a cross sectional view of a traditional Japanese blade with an original single factory bevel at 12°, a primary edge facet at 15°, and a small secondary bevel.

FIG. 7 is a cross section of a Euro-American knife with a triple beveled edge consisting of a primary 20° facet.

DETAILED DESCRIPTION

Figure 8:
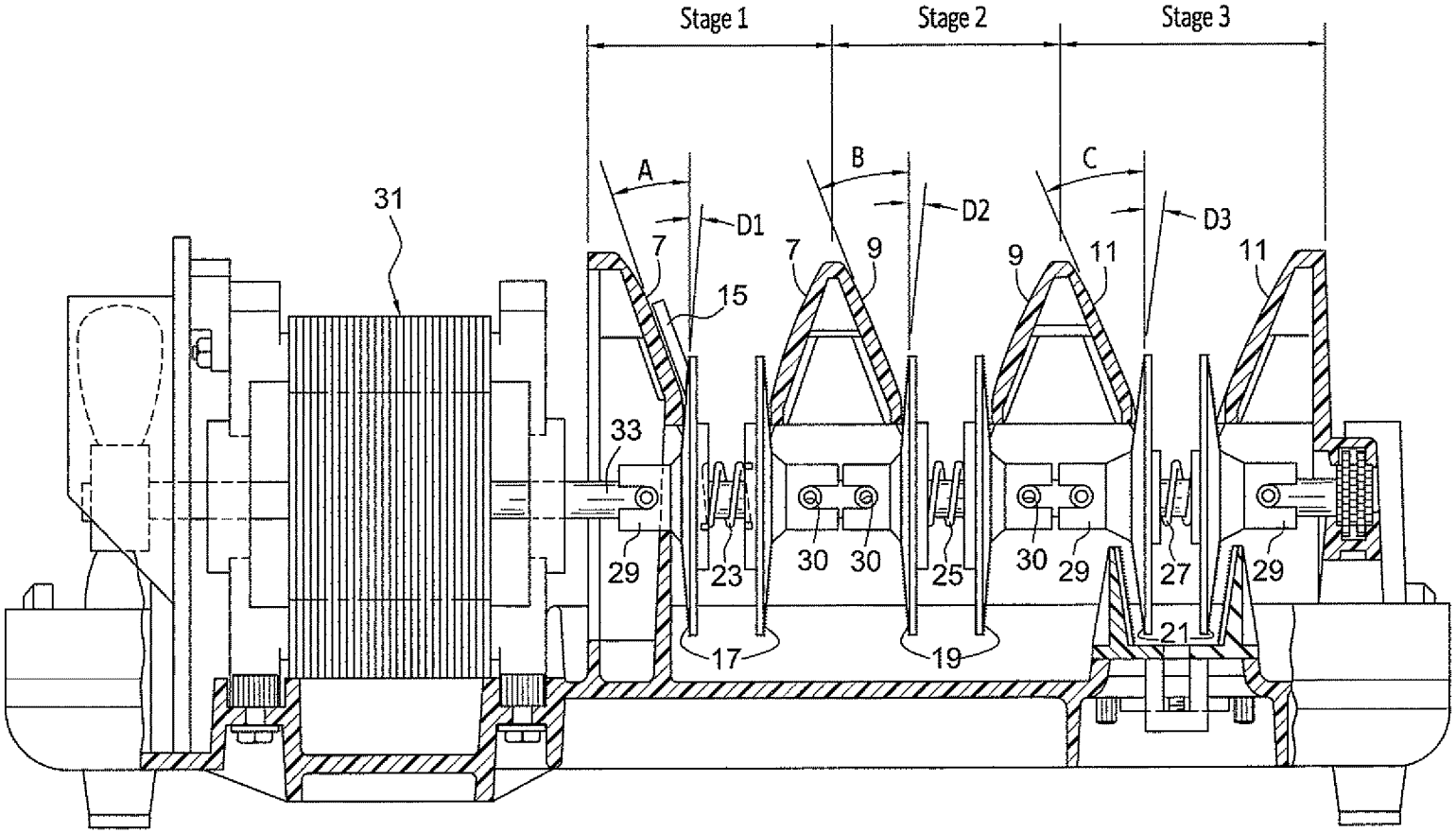
FIG. 8 is an example of a sharpener that incorporates elements of design discussed herein.

The difficulty of making one sharpener that can create factory quality edges on any of the very wide variety of knives in use throughout the world today is suggested by the varied cross sections and differences between such knives, illustrated by FIGS. 1 thru 6. FIGS. 1 and 2 illustrate the edge facets of a typical Euro-American knife blade 3 commonly sharpened with a primary angle of about 20° (FIG. 1.) This same knife shown in FIG. 2 has become available with a secondary bevel created at the edge of the facets at about a 22° angle. The strength and durability of that edge is related to the primary facet angle of 20° and to the size, angle and perfection of the 22° bevel created along the edge. The difficulty of cutting with a knife edge which acts in principle somewhat like a wedge, is also inversely related to the size of the primary edge angle. In general, the larger the primary facet angle on a blade the more durable its edge but as you increase that angle the knife may not seem to be as sharp when it is being used.

The durability of the edge itself which is commonly created at the junction of the two secondary small bevels, one at the terminus of each of the two primary bevels is directly related to the angle of those small secondary bevels. These small secondary bevels formed at an angle slightly larger than the primary facet angle make the edge stronger. These inventors have discovered that if these bevels can be made very small and if they are confined within the broad profile of the major primary edge facets, their effect on the ease of cutting can be vanishingly small. The small bevel must however be created with good control of the angle, with appropriate sharpening pressure and with high precision using a smaller grit than that used for the primary facets.

Edges on double faceted Asian knives illustrated in FIGS. 3 thru 6 are created with a primary angle on the facets of about 15° (FIG. 3) which as suggested creates an inherently sharper but weaker edge than the Western style blades sharpened at a primary angle of 20°. In order to compensate for the weaker edge of the Asian knives it is desirable to create at a larger angle a very small bevel adjacent the edge as shown in FIG. 4. This combination retains the apparent sharpness provided by the lower angled (15°) Asian facet edge but provides the edge with a strength and durability characteristic of the physically small but larger angled bevel. Consequently a two step process of sharpening first the primary 15° edge with a coarser grit followed by creating the small bevel adjacent the edge with precise angle and pressure control and with finer grit abrasive can allow this physically small bevel to provide a stronger but still very sharp knife edge. It is desirable in the most precise sharpeners to be able to create such small secondary bevels at the edge.

FIG. 6 illustrates further an unusual single faced traditional Japanese blade and how it is conventionally sharpened. The back face of this type blade traditionally is planar and the front face which has an upper section that is flat and parallel to the back face of the blade. However this unique blade has a very large lower beveled section ground onto the front blade face at the factory at about twelve degrees to the back face that meets the back face to create an edge. Characteristically a much smaller primary 15° facet is created at the terminus of the very large beveled section ground at the factory along the front blade face. This creates the equivalent of a somewhat conventional blade that is split down the middle of its thickness to the edge line. Commonly there is that small but visible 15° primary facet along the front bevel adjacent the edge as described here but the blade has no visible facet along the back side. The blades total primary cutting angle is only about 15° which means when you cut with the blade, it appears very thin to the food and the user finds the knife to be exceedingly sharp.

As related above, prior to this time individual precision sharpeners have been of dedicated design to create either an Euro-American 20° style edge or an Asian 15° style edge. The inventors are not aware of any sharpener available at this time that can do both styles of blades with the subtle secondary bevels described above. What these inventors have done is create a unique and advanced sharpener using only three stages that can create both style edges by incorporating a unique combination of sharpening angles, optimal abrasive sizes, a reduction in sharpening pressure (force) and employing new sharpening procedures that can sharpen all of the blades with the complex edge geometries described above to better than factory sharpness with enhanced durability. A very small secondary facet is crested adjacent to the edge to strengthen the edge. The edge qualities are in fact equal to or superior to most factory edges.

We have shown that the inherent advantage in sharpness of 15' primary edge facets can be maintained even though there is one or more small secondary bevels formed at a larger angle adjacent the edge in the lower 10-20% of the length of the primary facet. It is clear also that the durability of the primary 15° edge is enhanced by the presence of one or more such small but precise secondary bevels.

The most advanced modern 20° precision sharpeners, designed exclusively for the Euro-American knives, incorporate 3 stages to create a triple beveled facet. A first stage creates primary 20° facets on each side of the blade edge using a coarse abrasive which makes it possible to sharpen quickly even very dull blades. The second stage uses a somewhat finer abrasive grit then creates a second bevel on each facet adjacent the edge creating a double beveled edge structure. The third sharpening stage uses a finer abrasive grit to place a very small third bevel adjacent the edge. By this three stage process the finished edge as illustrated in FIG. 7 has a modified Gothic arch shape (triple beveled) which is recognized as an ideal shape for a stronger edge that will resist common dulling caused by bending over of the edge. It has been assumed until this time that optimal creation of a precision primary 20 degree edge required all three sharpening stages. What this new research has shown is that by judicious changes to the operating parameters and by devoting more time to the sharpening and stropping process a more sophisticated three stage sharpener can deliver factory quality edges for blades with either 15 or 20 degree primary facets.

FIG. 5 shows the complexity of a triple bevel edge created on a 15° Asian style blade. The value of a three stage sharpener to create such small bevels to strengthen primary facets of 15° is even more important at this lower angle edge. That is because a larger 20° edge is inherently stronger to begin with. A 15° primary angled edge is thinner directly behind the edge and hence weaker than a 20° edge. The user of an Asian style edge recognizes that it is very important to be able to add a small strengthening bevel adjust to the edge if that knife is used for anything other than the lightest duty work.

One of the popular Asian style knives described earlier is the Japanese traditional knife (FIG. 6) which is a single sided, single beveled blade sharpened principally on its front face. Its edge is formed below the very large 12° factory-made bevel on the front face of the blade by creating at the factory a small primary facet at 15° as shown in FIG. 6. Creating that facet leaves a small burr along the edge on the back side of the blade. After the front facet is fully sharpened that small burr (on the back side) is removed at the factory by creating a sometimes nearly invisible microfacet along that back side of the edge. Because of the precision and care needed to create these complex geometries it is not unusual in Asia to see an experienced chef take many minutes to sharpen one of these blades.

The novel sharpening system described here will sharpen to factory standards in only three stages not only the widely differing Western and Asian and Japanese knives but virtually all other sub-classes of knives including hunting and fishing knives, serrated knives and pocket knives, with factory quality or better edges.

This has been accomplished by these inventors using a novel three (3) stage motor driven sharpener (FIG. 8) with carefully sized diamond abrasives in the first two sharpening stages, designed selectively to create either a primary 20 degree edge facet or a primary 15 degree edge facet along the knife edge, and an unconventional third stage stropping disk of reduced aggressiveness accomplished by using uncommonly low pressure while stropping the final edge. (The stropping disk is constructed of an appropriately flexible plastic loaded with ultra fine (micron sized) abrasives and while it can create a micro facet it is commonly referred to as a stropping disk and not a sharpening disk.) This sharpener provides also means to either create primary and secondary facets on both sides of the blade or selectively only on the right or left side of the blade; this flexibility is particularly important for the Japanese traditional blades. Stage 1 is configured to at about 15°, Stage 2 at about 20° and Stage 3 strops at about 22°. This unconventional three stage sharpener which is described in more detail in the following sections incorporates novel features in each stage that in combination create professional factory quality edges on this wide range and variety of knives.

This novel motor 31 driven sharpener, FIG. 8 has two (2) sharpening stages, Stage 1 and Stage 2, and a single stropping Stage 3 as illustrated. A knife blade 15 is shown in the left slot of Stage 1 between knife guide 7 and the rotating diamond coated abrasive disk 17. This stage is designed for and dedicated to the initial sharpening of Asian style knives that have 15 degree primary facets and which are inserted alternatively in the left and then in the right slot of the first stage between the guide 7 and corresponding sharpening disk 17. In this arrangement the guiding surface of guide 7 in Stage 1 is set at approximately 15° to the vertical, which is close to the angle of the primary facet on Asian blades. The surface of the abrasive covered disks in each Stage at the point of knife contact may have the geometry of a truncated cone and consequently that surface areas on the disk may be set at a small angle D to the vertical. (Angle D may be different in each stage depending on the contour of each disk and variations in contact point of the knife facet.) Therefore, the resultant angle that will be created on the facet being sharpened as shown would be approximately the sum of angles A & D. That resultant angle may also be affected by any taper of the knife faces relative to the centerline of the blade thickness. It is important therefore to select angle A with this in mind when establishing the angle of knife guide 7. For the sake of simplicity when the inventors refer to the angle of any stage it is to be interpreted as the nominal resultant angle of the facet being created at the edge relative to the center line of the blade thickness. The actual angle formed may be slightly different as explained later.

The motor 31 drives shaft 33, FIG. 8, on which sharpening disks 17 and 19 and stropping disks 21 are slidingly mounted. Each disk is pressed by a carefully prescribed precision spring 23, 25, or 27 respectively toward the corresponding knife angle guides 7, 9 and 11 to provide an optimum sharpening pressure, to help support the knife securely against the knife guide and to insure good initial contact of the primary blade facet with the abrasive disk. The slotted supporting hubs 29 are pressed by these springs against stop pins 30 which establish the position of the disks precisely adjacent the knife's angle guides when there is no knife in the sharpening position.

Euro-American style knives, which commonly have a 200 primary angle are sharpened first in Stage 2 of this new sharpener. In Stage 2 the knife guides 9 are set at angle B to the vertical. To accommodate the wide range of knives of FIGS. 1 thru 6, angle B should be about 20° or slightly less, as noted above, depending on the added angle D which would be similar in magnitude to that angle illustrated in Stage 1.

In Stage 3, the knife guides 11 are set at an uncommonly large angle C to the vertical, as related to Stage 1. This angle C which must be somewhat larger than angle B of Stage 2 is set at about 21 to 22 degrees or slightly less. Again if the stropping disks 21 are shaped as truncated cones their shape at the point of facet contact will add slightly to the angle of the knife guide. All knives after their initial sharpening in Stage 1 or Stage 2 are finished by stropping in Stage 3.

To create the primary facet angle of about 15 degrees as needed for Asian knives, stage 1 of this new sharpener is designed to sharpen at about that angle but using a substantially less aggressive abrasive action than conventional for 15 degree blades in order to leave a smaller than usual burr on the knife edge after sharpening in Stage 1. This action is accomplished using diamond abrasives of finer than 200 grit and preferably all or at least predominantly of 230-270 grit together with an uncommonly low spring tension, such as, about 0.3-0.4 pounds which is about half the force (0.6-0.72 lb) used for the first (initial) stage of a conventional sharpener of knives at about 15 degrees. The spring tension can be reduced below 0.3 pounds but the time to sharpen increases. Leaving a smaller burr on the blade edge is important and necessary in order to make it possible to remove that burr in a reasonable time with an unconventionally mild abrasive action required of the stropping disk in Stage 3. That stropping disk in Stage 3 can not be made more aggressive (in view of the uncommonly large angular difference of about 7° between the edge angles being formed in Stages 1 and 3) without itself creating a burr too large which would leave a very dull edge on the finished knife. The ultimate customer of the Asian knife demands that the final edge be extremely sharp in order to make perfect thin cuts for example with sashimi blades. In fact for any Asian style blade the user expects the edge to be exceedingly perfect and sharp.

As noted the second stage of this novel sharpener is set to create a primary facet at about 20° as necessary for the initial sharpening of Euro-American knives. In this stage also it was found necessary to use an unconventionally lower abrasive action and a smaller abrasive size than used in the first (initial) sharpening stage of conventional three stage 20° angle sharpeners. It is important to note that in fact it is necessary to leave a smaller than conventional burr before the next step of stropping where we found for several reasons that it was necessary to use a much milder than normal stropping action. The burr left on the edge after Stage 2 must be small enough to be removed fully in a reasonable time in the Stage 3 designed with its uncommonly mild stropping stage. Consequently in Stage 2 which is the initial sharpening stage for knives with 20° primary facets the optimal diamond abrasive is of finer than 200 grit and preferably all or at least predominantly of 230-270 grit which is much finer than the 100-200 grit conventionally used in the first sharpening stage of a 3 Stage 20° precision sharpener. The spring tension found to be optimal was 0.3 to 0.4 lb which is on the low side of conventional springs that are, commonly as high as 1.4 pound in the first stage of conventional 20° sharpeners operated at 3600 rpm. The spring tension can be reduced below the cited range but the sharpening time increases.

The Stage 3 stropping stage is set to strop at approximately 22 degrees which as stated is unconventionally 7 degrees larger than the 15 degree primary facet created in the preceding sharpening of Asian knives in Stage 1. That very large and unconventional 7 degree difference puts further severe demands on the stropping stage to be able to remove promptly enough the sizable burr created on an Asian knife in Stage 1 and to polish that edge to a superior sharpness all in a reasonably short time. If the stropping in Stage 3 were instead designed to be more aggressive (to save stropping time) by using a spring of conventional force, there would be the danger of bending over the edge, and the likelihood that an unacceptably large new burr will be left on the remaining blade edge and the knife will as a result be unacceptably dull.

The fact that there is not a dedicated less aggressive second sharpening operation in this new sharpener that would remove the large burr created in the first sharpening stage puts greater demand on workable parameters for this new design where there is only one single sharpening stage whether it be Stage 1 as designed for Asian blades or whether it be Stage 2 as designed as a first stage for Euro-American blades. Because there is in general use only one sharpening stage for a given knife depending on its style that stage must be aggressive enough to sharpen a very dull blade but gentle enough to leave a smaller than normal burr, one that the stropping Stage 3 can handle (to remove the burr and polish the edge) in a reasonable time and yet leave essentially a burr-free and extremely sharp edge. The task for Stage 3 is, as stated, further exacerbated by the large angular difference between Stages 1 and 3, the two stages where the Asian knives are processed. Obviously as that angular difference between the preceding stage and the stropping stage increases, the opportunity for the stropping stage to bend over and dull the edge is greatly increased. Previously it has been believed that such a large angular difference a stropping stage and the preceding sharpening stage was an impractical concept for creation of an edge of highest quality. Previous three stage sharpeners whether for Euro-American knives or Asian knifes have customarily selected the guide angles with only about a 2 degree difference between any two stages to be used only by a given knife style. Small angular differences have previously been considered to be essential to minimize the size of burrs created while forming the secondary bevels at the edge itself.

For purposes of this invention angle A of Stage 1, used for Asian knives could be in the range of 12-18 degrees with 15 degrees being preferred. Angle B, in Stage 2, used for Euro-American knives, could be in the range of 17-23 degrees with 20 degrees being preferred, Angle C in Stage 3 could be in the range of 19-25 degrees with 22 degrees being preferred. Angle C should, however, not be less than Angle B. Thus, as used herein an Asian knife has its resulting primary edge facet centered at an angle in the range of 12-18 degrees and a Euro-American knife has its resulting primary edge facet centered at an angle in the range of 17-23 degrees. A Japanese knife is an Asian knife with only one facet and with an opposite flat back face.

The above angular ranges result primarily from the angle made by the primary edge facet as it contacts the disk but the final angle is influenced also by the angle of the face of the blade relative to the centerline of the blade and to a lesser degree by the third stage stropping or sharpening at the point of contact with the third stage disk. There is therefore a strong relationship between the facet angle and the angle of the guide surface with respect to the vertical. Although the angle of the guide surface may differ from the actual facet angle by about 1-1½ degrees, for purposes of this invention, the guide surface could have its angles A, B and C in the same ranges of 12-18 degrees, 17-23 degrees and 19-23 degrees, respectively, to result in the desired facet angle.

As used herein, a low spring force could be slightly lower than 0.6 pounds. Preferably the spring force is less than 0.6 pounds. More preferred ranges are 0.1-0.5 or 0.2-0.5 or 0.2-0.4 or 0.2-0.3 or 0.3-0.4 pounds.

U.S. Pat. No. 6,875,093 discloses a sharpener which uses a spring force in the order of 0.2 pounds. More specifically, a disk made of a metal stamping is coated with ultra fine abrasives. When used in a multi-stage sharpener, the disk having such ultra light spring is in the last or finishing stage, while a disk in the prior stage which obtains far more aggressive presharpening uses a heavier spring than that of the finishing stage. This differs from the preferred practices of this invention in a number of respects. For example, with this invention, the preliminary Stages 1 and 2 must use a low spring force, unlike the heavier spring called for in the '093 patent. In addition, in a preferred practice of this invention, the last stage, Stage 3, uses a flexible stropping disk, whereas in the '093 patent, the last stage uses a metal stamped disk which would be for finishing purposes, not stropping. The '093 patent does not disclose using a low spring force for a non rigid flexible stropping disk.

These inventors have demonstrated that the advantages in perceived sharpness of the primary angles can be best maintained if the secondary bevels are very small being formed only in the lower 20-30% of the facet length adjacent the edge. If this is done with sufficient precision and light sharpening pressures the perfection of the edge geometry is improved as each small facet is added and the geometric advantage of the lower primary angle is largely retained. By contrast if overly aggressive means of sharpening or stropping are used the primary facet may be completely replaced by physically large bevels that are substantially larger in angle than the primary facet and the edge appears in fact to be not as sharp. The primary facet angle of a given style knife must be selected appropriately considering the force that the edge will encounter in its normal usage. That is why the Asian knife edge intended for lighter duty is created at a lower angle primary facet and the Western edge is formed at larger angles to do heavier work. It is important therefore in adding secondary bevels that they be made physically small and with the highest possible perfection to enhance the edge strength without reducing the apparent sharpness at the extremities of the facets. The use of a less aggressive stropping disk to create small secondary bevels proved advantageous if that disk is sufficiently aggressive to remove the burr created in the preceding sharpening stage yet not be so aggressive that it leaves an unacceptably large burr as the stropping disk creates a small secondary bevel.

The improvement in edge performance that can be realized by limiting the physical size of secondary bevels lends further importance to the need to limit the aggressiveness of the preceding sharpening stage and also the stropping Stage 3 itself. Consequently special and critical consideration must be given to the size of the abrasive grits and the spring pressure especially in the final step, namely the stropping Stage 3. We found it optimal in this unconventional approach to reduce the spring tension to a range of from 0.1 to less than 0.6 pounds in the stropping stage which is a factor ranging from six to 16 times less than the tension 0.6 to 1.6 pounds used in conventional dedicated sharpeners for either the 15° Asian or 20° Euro-American blades. The abrasive grit in the stropping stage is of an average size less than 20 microns and optimally about 3 microns. Aluminum oxide and silicon carbide abrasives proved appropriately aggressive for this special use. (See U.S. Pat. No. 5,611,726, U.S. Pat. No. 6,012,971, U.S. Pat. No. 6,113,476 and U.S. Pat. No. 6,267,652B1.)

Thus these inventors have developed a unique combination of sharpening and stropping disks, sharpening angles, abrasive sizes, and sharpening/stropping pressures which will permit a single three stage sharpener to produce such superior edges on this exceptionally wide range of knife designs. As described earlier this design places significant restraints on the aggressiveness of all sharpening and stropping stages. In order to create Asian knives with a strong edge geometry as shown in FIG. 4, 5 or 6 one would sharpen first in Stage 1 at about 15 degrees and then move to Stage 3 at about 22 degrees. Moving from a facet angle of 15 degrees to stropping at about 22 degrees is a 7 degree change. As explained earlier this is an exceedingly large angle change when compared to prior standards of a 2 to 3 degree difference intended to avoid bending over the edge and creating excessively large secondary facets. It is to be understood that the invention can be practiced even though angle C exceeds angle A by at least 5 degrees or more. Excellent results were repeatedly achieved with 7 degrees differential. What we have shown is that by creating the primary facet with a less aggressive sized abrasive the degree of edge refinement needed is reduced in the following step and that greater refinement can be achieved with a less aggressive means in the stropping Stage 3. This means that Stage 3 can create a far superior edge refinement and create a small precise facet in spite of the greater angular difference between stages.

While Asian knives are characteristically sharpened with primary facets of about 15 degrees along the edge regardless of their physical cosmetic styling and Euro-American blades are sharpened with primary facets of 20° regardless of styling, either style knife can be converted functionally to the other by following the sharpening procedures for the other style as outlined here. Therefore the sharpening procedures as outlined here for creating an Asian style edge apply to creating an edge with primary facets of about 15° irrespective of the physical appearance or original intentions and designations of the knife manufacturers, The same is also true for creating an Euro-American 20° edge on a knife originally sold as an Asian style blade. This versatility ability to convert edges from one style to the other is a unique feature of the unusual sharpener described here.

Further, it is interesting to note that by choosing a smaller than conventional grit for 20° (Euro-American) knives, that is less than 200 grit, to form the primary facet the sharpening time is increased slightly but fortunately we discovered that (because a smaller burr is formed) there is a compensating reduction in the time needed to remove its residual burr during the stropping step.

These values were demonstrated in a sharpener similar to FIG. 8 with sharpening disks of approximately 2 inch diameter driven by a motor at about 3600 rpm. The linear surface speed of the abrasive at the point of disk contact with the blade facet was about 1000-1500 feet per minute.

The design parameters as developed are highly critical to the success of this new and uncommonly versatile sharpener that is demonstrably capable of placing exceedingly sharp and durable edges on the wide range of knives described here. It is totally compatible also with heavy hunting blades that are best sharpened first in Stage 2 (not in Stage 1) at 20 degrees. The large faces of heavy hunting knives are characteristically beveled at the factory at 5 degrees to the center line of the blade thickness and hence when sharpened in Stage 2 (20 degrees) their facets will be automatically sharpened at 15 degrees as referenced to the center line of the thickness of those blades. That has been historically the preferred angle for heavy duty hunting knives.

It should be understood that while we concentrate in this disclosure on those essential elements of this sharpener design that are critical to obtain factory quality edges on this unusually wide range of knives in a single sharpener there are variations in physical structure that we have found operative but perhaps not as convenient as those described here in greater detail. For example while we illustrate in FIG. 8 compression springs 23, 25 and 27 as the spring mechanism to press the individual disks 17, 19 and 21 against the stop pins 29 and 30 there is for example the alternative where the disks are fixed in position rigidly onto the motor shaft and the individual 7, 9 and 11 knife angle guides are mounted slidingly and can be displace against similar spring mechanisms when a knife is inserted in the slots between the knife angle guide and the disks. Regardless of the physical design selected to mount the disks and its knife angle guides the total restoring force provided by the spring mechanism in each stage must remain in the force range described elsewhere in this patent (allowing however for frictional factors) for optimal performance on this wide range of knives.

Other design variations were shown to be possible but the quality of the resulting knife edges was not as good. We have found for example that rigid abrasive surfaced disks can be substituted for the flexible stropping disks in Stage 3. The optimal spring force required with rigid disks is on the order of no greater than 0.35 pounds and preferably 0.1-0.35 pounds and more preferably 0.1 pounds which is at the low end of the 0.1 to about 0.6 pounds that we found optimal for the flexible disks. The abrasive used with the rigid disks is preferably of a size less than 1,000 grit and is preferably diamonds but others such as alumina and silicon carbide can be used.

This new sharpener is designed to avoid overly aggressive sharpening in all stages in order to; (a) improve the quality of edge of the primary facet and of all secondary bevels as they are created; (b) to minimize the size of all secondary bevels as a percentage of the length of the primary facet; and (c) to accommodate the unusually large angular difference between the approximate 150 angle in the first stage necessary to create the primary facet of Asian blades and the approximate 220 angle of the Stage 3 stropping stage that forms the final facet for all types of knives.

In general, the invention may be practiced as follows. When the user sharpens an Asian or Japanese style knife blade, the user places the blade against the guide surface in Stage 1 with the facet against the Stage 1 disk and the sharpener causes the disk to rotate and sharpen the facet while urging the Stage 1 knife guide and disk toward each other under low spring force. The user then places the blade against the guide surface in Stage 3 with the facet against the Stage 3 disk and the sharpener causes the disk to rotate and contact the facet while urging the Stage 3 knife guide and disk toward each other under low spring force to either strop or sharpen the facet. When the user sharpens a Euro-American style knife blade, the user places the blade against the guide surface in Stage 2 with the facet against the Stage 2 disk and the sharpener causes the disk to rotate and sharpen the facet while urging the Stage 2 knife guide and disk toward each other under low spring force. The user then places the blade against the guide surface in Stage 3 with the facet against the Stage 3 disk and the sharpener causes the disk to rotate and contact the facet while urging the Stage 3 knife guide and disk toward each other under low spring force to either strop or sharpen the facet. The invention could be practiced wherein after the user sharpens a knife edge in Stage 1, the user further sharpens the knife edge in Stage 2 before stropping or sharpening the knife edge in Stage 3. Alternatively, after the user sharpens the knife edge in Stage 1, the user immediately strops or sharpens the knife edge in Stage 3 without using Stage 2. For Euro-American knives, after the user sharpens the knife edge in Stage 2, the user immediately strops or sharpens the knife edge in Stage 3 without using Stage 1.

It is to be understood that while the disclosures here use the terms Stage 1, Stage 2, and Stage 3 these are not to be interpreted as being placed in any one physical order or location within the sharpening structure but rather as a means of describing and identifying the specialized parameters of each Stage and the unique sequence of this usage.

This unique sharpener arrangement does an outstanding job of sharpening the very wide range of knife design that have their origins in the widely different Eastern and Western cultures. The edge perfection being obtained by this new technology is at a level that requires optical microscopes to see any defects in the fine edges as they are finally stropped. Direct visual examination is not effective in evaluating the final edge quality. Consequently the user of this sharpener must rely on and follow carefully the instructions provided.

This new less aggressive approach greatly enhances the sharpness of the finished blade in spite of established logic and experience to the contrary.

What is claimed is:

1. An electric knife sharpener for selectively optimally sharpening an Asian or Japanese style knife and a Euro-American style knife with the same sharpener wherein each such knife has a blade edge with a primary facet on at least one side of the blade edge, said sharpener having a first stage and a second stage and a third stage, said sharpener having a motor driven shaft, said first stage having at least one rotatable abrasive surfaced disk mounted on said shaft for sharpening a blade edge, a first knife angle guide in said first stage having a guide surface to position the blade edge facet into contact with said first stage abrasive surfaced disk to create a primary facet along the blade edge, said first stage guide surface with respect to the vertical being at an angle A which is about 15 degrees, a first spring arrangement urging said first stage disk and said first stage guide relatively toward each other with a spring force of less than 0.6 pounds, said first stage disk having its abrasive surface formed from abrasives of predominantly on the order of 230-270 grit, said second stage having at least one rotatable abrasive surfaced disk mounted on said shaft for sharpening a blade edge, a second knife angle guide in said second stage having a guide surface to position the blade edge facet into contact with said second stage abrasive surfaced disk to create a primary facet along the blade edge, said second stage guide surface with respect to the vertical being at an angle B which is 17-23 degrees, a second spring arrangement urging said second stage disk and said second stage guide relatively toward each other with a low spring force of less than 0.6 pounds, said second stage disk having its abrasive surface formed from abrasives finer than 200 grit, said third stage having at least one rotatable abrasive surfaced disk mounted on said shaft for contacting the blade edge, a third knife angle guide in said third stage having a guide surface to position the blade edge facet into contact with said third stage abrasive surfaced disk, said third stage guide surface with respect to the vertical being at an angle C which is 19-25 degrees and which is at least as great as angle B, a third spring arrangement urging said third stage disk and said third stage guide relatively toward each other at a low spring force of less than 0.6 pounds, and said third stage disk having its abrasive surface formed from abrasives predominantly no greater than 20 microns.

2. The sharpener of claim 1, wherein said spring force in said third stage is in the range of 0.1-0.5 pounds, and said third stage disk being a flexible stropping disk.

3. The sharpener of claim 1, wherein said angle B is about 20 degrees, and said angle C being about 22 degrees.

4. The sharpener of claim 1, wherein said third stage disk is an abrasive coated rigid disk having its abrasive of a size less than 1,000 grit, and the abrasives of said third stage disk are diamonds.

5. The sharpener of claim 4, wherein the spring force in Stage 3 is no greater than 0.35 pounds.

6. The sharpener of claim 1, wherein said spring force is in the range of 0.3-0.4 pounds for said first and said second stages, and said spring force in said third stage being in the range of 0.1-0.5 pounds.

7. The sharpener of claim 1, wherein the abrasives on said disks in said second stage are predominantly on the order of 230-270 grit.

8. The sharpener of claim 1, wherein each of said stages includes a set of two knife guides and two corresponding disks slidably mounted on said shaft, and each of said spring arrangements urging each of said disks against a respective knife guide.

9. A method of using the same electric knife sharpener for selectively sharpening an Asian or Japanese style knife characterized by an edge bevel angle of about 15 degrees and a Euro-American style knife characterized by an edge bevel angle of about 20 degrees wherein each such knife has a blade edge with a primary facet on at least one side of the blade edge, the method comprising the steps of providing a three stage electric sharpener having in Stage 1 at least one rotatable abrasive surfaced disk with its abrasives being finer than 200 grit and having a knife guide with its guide surface being at an angle A which is 12-18degrees to the vertical and which positions a knife edge facet into contact with the Stage 1 abrasive surfaced disk, the knife sharpener having in Stage 2 at least one rotatable abrasive surfaced disk with its abrasives being finer than 200 grit and having a knife guide with its guide surface being at an angle B which is 17-23 degrees to the vertical and which positions a knife edge facet into contact with the Stage 2 abrasive surfaced disk, the knife sharpener having in Stage 3 at least one rotatable abrasive surfaced disk with its abrasives being predominantly no greater than 20 microns and having a knife guide with its guide surface being at an angle C which is 19-25 degrees to the vertical but which is at least as great as angle B; the user sharpening an Asian or Japanese style knife edge by the user placing the blade against the guide surface in Stage 1 with the facet against the Stage 1 disk and the sharpener causes the disk to rotate and sharpen the facet while urging the Stage 1 knife guide and disk relatively toward each other under low spring force, the user then places the blade against the guide surface in Stage 3 with the facet against the Stage 3 disk and the sharpener causes the disk to rotate and contact the facet while urging the Stage 3 knife guide and disk relatively toward each other under low spring force; and the user in a different and distinct sharpening sequence sharpening with the same sharpener a Euro-American style knife edge either before or after the Asian or Japanese style knife is sharpened by the user placing the blade against the guide surface in Stage 2 of the sharpener with the facet against the Stage 2 disk and the sharpener causes the disk to rotate and sharpen the facet while urging the Stage 2 knife guide and disk relatively toward each other under low spring force, and the user then places the blade against the guide surface in Stage 3 with the facet against the Stage 3 disk and the sharpener causes the disk to rotate and contact the facet while urging the Stage 3 knife guide and disk relatively toward each other under low spring force.

10. The method of claim 9, wherein a burr is formed on the edge facet in each of Stages 1 and 2, and the remaining burr is removed in Stage 3.

11. The method of claim 9, wherein after the user sharpens an Asian or Japanese style knife edge in Stage 1, the user immediately places the knife edge in Stage 3 without using Stage 2.

12. The method of claim 9, wherein after the user sharpens a Euro-American style knife edge in Stage 2, the user immediately places the knife edge in Stage 3 without using Stage 1.

13. The method of claim 9, wherein the sharpener includes two sets of disks and knife guides in each of Stages 1 and 2; for Asian style and for Euro-American style blades, the user sharpens the blade in its respective Stage 1 and Stage 2 by alternately placing one facet against one disk and then another facet against the other disk of its respective Stage; and the user sharpens a Japanese style knife blade having only one primary facet and a flat side by the user sharpening only the one primary facet by using only one knife guide and its disk in each of the stages being used.

14. The method of claim 9, wherein a secondary bevel formed on the knife edge in Stage 3 is in the lower 20-30% of the facet length adjacent the edge.

15. The method of claim 9, wherein the sharpener is provided which has disks in Stages 1 and 2 where the abrasive used to cover the surface of the respective disk is predominantly on the order of 230-270 grit, and the spring force in each of Stages 1 and 2 and 3 is less than 0.6 pounds.

16. The method of claim 15, wherein the spring force in Stages 1 and 2 is 0.3-0.4 pounds, and wherein angle A is about 15 degrees and angle B is about 20 degrees and angle C is about 22 degrees.

17. The method of claim 9, wherein the disk in Stage 3 is a flexible stropping disk and the spring force in Stage 3 being 0.1-0.5 pounds, and the knife edge is stropped in Stage 3.

18. The method of claim 9, wherein the disk in Stage 3 is an abrasive coated rigid disk, and the knife edge is finished in Stage 3 by contact with the rotating abrasive coated rigid disk.

19. The method of claim 9, wherein a sharpener is provided in which the angle C is at least 5 degrees greater than angle A.

20. The method of claim 12, wherein after the user sharpens an Asian or Japanese style knife edge in Stage 1, the user immediately places the knife edge in Stage 3 without using Stage 2.

21. The method of claim 9, wherein the spring force in Stage 3 is no greater than 0.35 pounds.

22. The method of claim 9, wherein the angle A is about 15 degrees.

* * * * *